US006708848B2

(12) United States Patent
Sheridan et al.

(10) Patent No.: US 6,708,848 B2
(45) Date of Patent: Mar. 23, 2004

(54) BEVERAGE DISPENSER

(75) Inventors: Kenneth Sheridan, Wokingham (GB); Ian Norman Painter, Wan Chai (HK); Robert Martin Finnegan, Oxford (GB); Martin Thorpe, Witney (GB); Lionel Chew, Monaco (MC); Doug Hamilton, London (GB)

(73) Assignee: Watson Enterprises Limited (VG)

( * ) Notice: Subject to any disclaimer, the term of this patent is extended or adjusted under 35 U.S.C. 154(b) by 0 days.

(21) Appl. No.: 10/097,158

(22) Filed: Mar. 13, 2002

(65) Prior Publication Data

US 2002/0162856 A1 Nov. 7, 2002

(30) Foreign Application Priority Data

Mar. 16, 2001 (GB) ..... 0106518

(51) Int. Cl.[7] ..... B67D 5/62

(52) U.S. Cl. ..... 222/146.6; 222/135.1; 222/189.09

(58) Field of Search ..... 222/146.6, 184, 222/185.1, 189.09, 485.1

(56) References Cited

U.S. PATENT DOCUMENTS 5,213,597 A * 5/1993 Campbell ..... 55/385.1
5,526,961 A * 6/1996 Burrows ..... 222/185.1
5,744,028 A * 4/1998 Goto et al. ..... 210/181
5,868,944 A * 2/1999 Wright et al. ..... 210/758
5,979,709 A * 11/1999 Liccioni ..... 222/185.1
6,179,168 B1 * 1/2001 Desrosiers et al. ..... 222/185.1

* cited by examiner

*Primary Examiner*—Joseph A. Kaufman
(74) *Attorney, Agent, or Firm*—Ira S. Dorman

(57) ABSTRACT

A water cooler has three vertically elongate arcuate walls 2, 3 and 4 and a removable top cover 6 which is adapted to receive and support an inverted bottle with its neck passing through an aperture 15 in the top cover. An internal platform is mounted below the top cover to receive a removable coupling member which incorporates a feed tube for insertion into the neck of the container. The platform also contains an opening in registration with a thermal receptacle mounted below the platform for receiving a reservoir connected to the feed tube to receive water from the container, and may also receive other replaceable components such as an air filter. An apertured ventilation duct 5 extends vertically at the junction between the side walls 3 and 4 and is rigidly connected to two structural members by the platform, a base plinth 1 and an internal bulkhead. The front wall 2 is fixed to the two structural members by screws while the side walls have hook formations which engage slots in the structural members and the duct.

16 Claims, 6 Drawing Sheets

BEVERAGE DISPENSER

TECHNICAL FIELD OF THE INVENTION

This invention relates to beverage dispensers of the kind which dispense cooled, ambient and/or heated liquids, which are supplied from a bottle or similar container mounted on the dispenser.

BACKGROUND

Beverage dispensers commonly found in offices and similar premises are rectangular in plan view with four vertically elongate sides. Generally, the rear of the dispenser is substantially open to permit free air circulation and cooling. Consequently, such dispensers tend to occupy a considerable amount of space, and they must also be situated to permit adequate ventilation.

The liquid to be dispensed (generally water) is transferred from the container into a holding reservoir within the dispenser, wherein the liquid may be cooled or heated before being dispensed from a valve into a cup or other receptacle. In order to improve the hygiene in such dispensers it is now common to provide a reservoir which can be removed along with the bottle coupling and associated interconnections. Thus, the removable components can be replaced with clean items at regular intervals. For this reason, and for general maintenance, it is necessary to gain access to the internal components through a removable panel of the dispenser.

The present invention seeks to provide a new and inventive form of beverage dispenser which as well as being hygienic is very compact whilst at the same time providing easy access when changing the replaceable components.

SUMMARY OF THE INVENTION

The present invention proposes a beverage dispenser which incorporates:

- three vertically elongate walls, namely a front wall and a pair of side walls which converge rearwardly from the front wall;
- a top cover which is removably mounted on said elongate walls and which is adapted to receive and support an inverted liquid container with a neck of the container passing through an aperture in said top cover;
- a platform mounted below said top cover, said platform being adapted to removably receive and support a coupling member which incorporates a feed tube for insertion into the neck of such a container when supported on the top wall, the platform further containing an opening which is in registration with a thermal receptacle mounted below said platform for removably receiving a reservoir through said opening, said reservoir being connected to the feed tube to receive liquid from said inverted container.

The front and side walls are preferably generally arcuate in transverse cross-section.

The platform preferably contains one or more holes for insertion of a conduit through which liquid is removed from the reservoir. The platform may also be adapted to receive other replaceable components. For example, the platform may hold an air filter through which air is conducted to the feed tube to replace liquid removed from the bottle, a non-return valve etc. The platform may also incorporate a dispensing valve for controlling the flow of liquid through the conduit. The platform may conveniently be formed as a plastics moulding.

Preferably a ventilation duct extends along the junction of the convergent side walls, said duct containing a plurality of ventilation apertures at different heights which communicate with the external atmosphere. The dispenser may include a fan arranged to create a positive air flow between the interior of the housing and the ventilation duct or vice versa. Thus, the duct may be of relatively small volume but will still provide adequate ventilation with minimum risk of obstruction.

The ventilation duct is preferably rigidly connected with spaced substantially parallel structural members at the front of the housing. At the top of the housing the platform may rigidly connect the duct with the two structural members while a base plinth may rigidly connect the duct and structural members at the lower end of the housing. An intermediate bulkhead may also rigidly connect the duct with the structural members.

The front wall of the housing may be fastened to the two structural members, e.g. using screws. The two side walls are preferably provided with downwardly-directed hook formations which are inserted into vertical slots provided in one flank of the duct and one of the structural members.

The structural members preferably include a pair of angularly-inclined wall sections. The outer edges of both angularly-inclined sections are preferably provided with substantially perpendicular flanges. Thus, the two members can be very strong but relatively lightweight.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
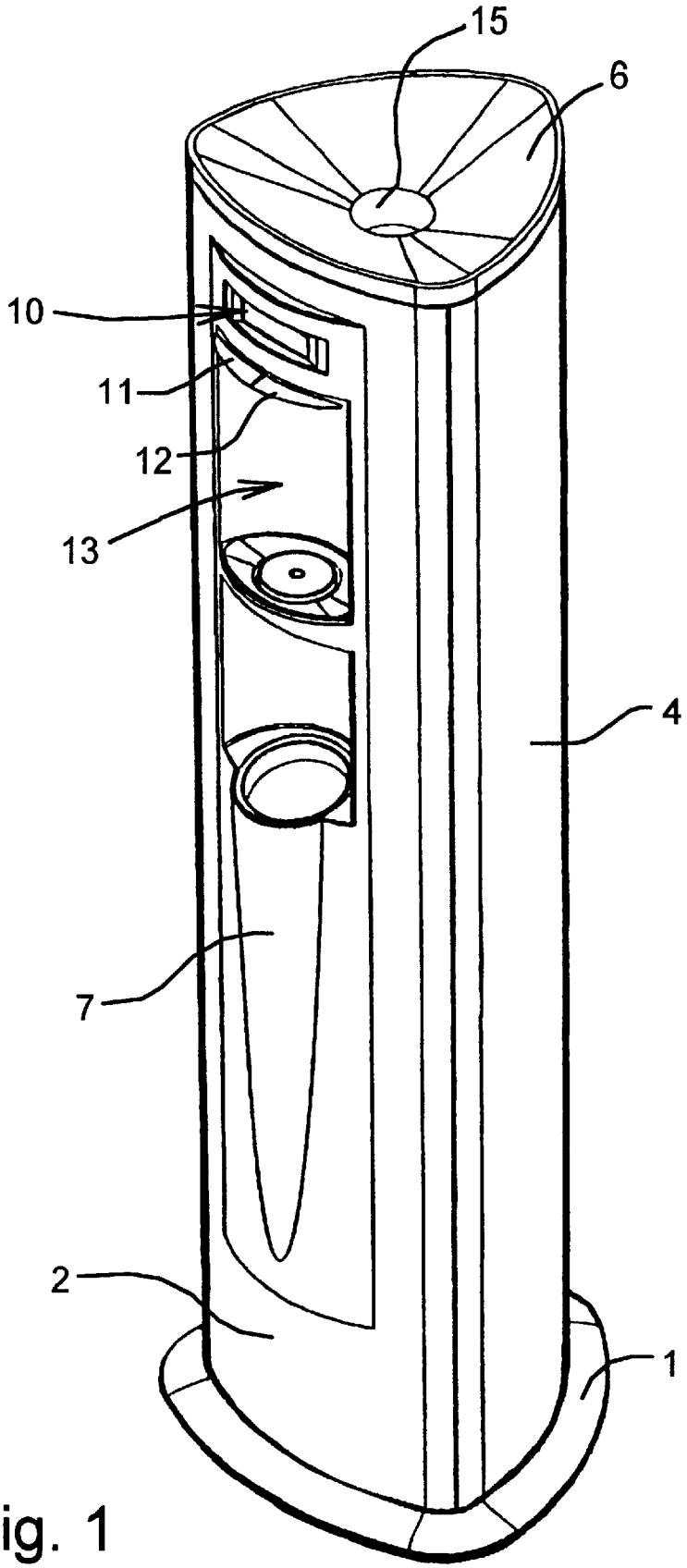
FIG. 1 is a general view of a beverage dispenser in accordance with the invention.
Figure 2:
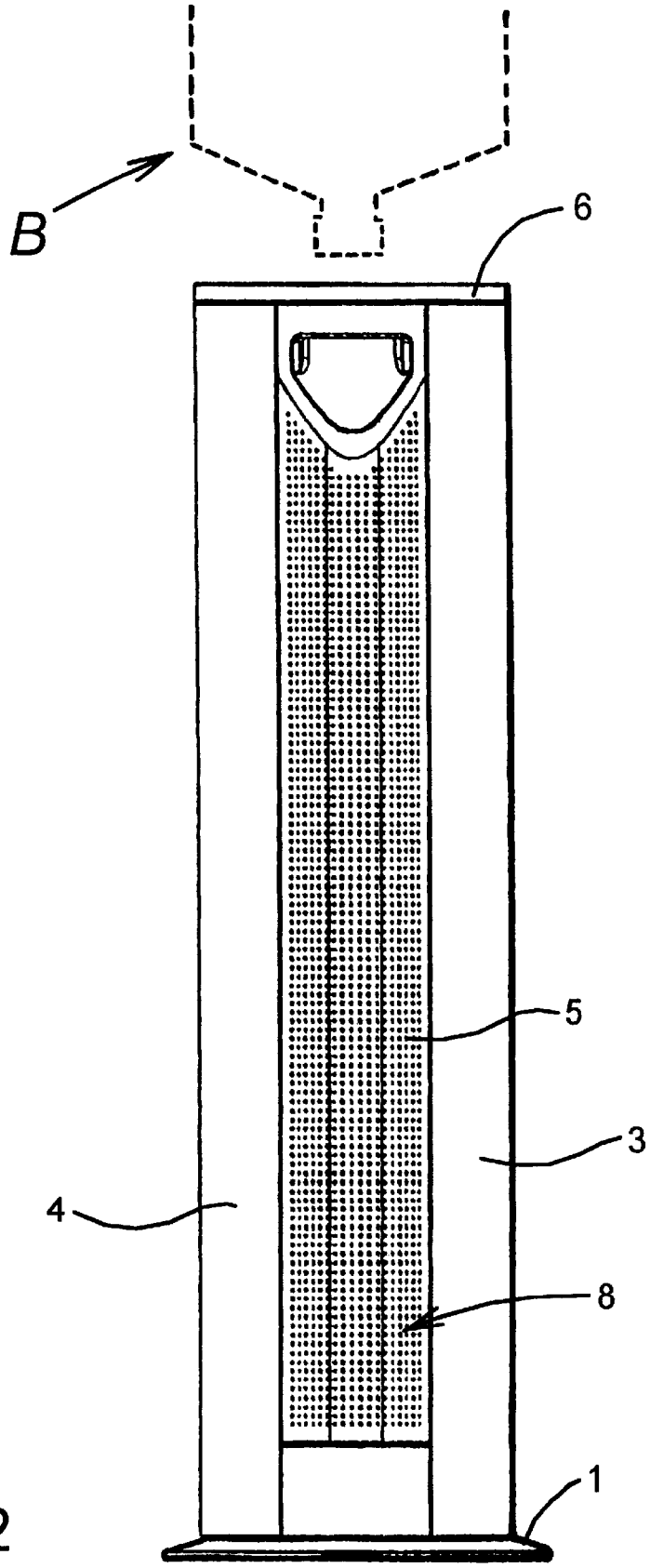
FIG. 2 is a rear view of the beverage dispenser showing the ventilation duct and a water bottle for use with the dispenser.

FIGS. 1 and 2 show a beverage dispenser of the kind which dispenses chilled water and is therefore commonly referred to as a water cooler. The cooler includes a plinth 1, a vertically elongate upstanding front panel 2 and a pair of side panels 3 and 4 which converge rearwardly to meet a ventilation duct 5 which extends vertically between the rear margins of the side panels. The front and side panels are all moulded of plastics and are outwardly arcuate in transverse cross section such that the external profile of the cooler is smoothly curved with three similar sections (see FIG. 4). In addition, a top cover 6, which is also moulded of plastics, is removably supported on the front and side panels. The duct 5 occupies most of the height of the cooler and is closed at its top and bottom ends. The external wall of the duct contains an array of ventilation holes 8 covering most of the vertical length of the duct.

The front panel of the cooler has an electronic display panel 10, below which are a pair of control levers 11 and 12 for electrically or manually operating a pair of dispensing pinch valves which control the discharge of water into a dispensing recess 13. Below the recess 13 there is an opening 14 through which moulded cups can be removed from a tube 7 (FIG. 3) to receive the dispensed water.

The water is obtained from a container in the form of a bottle B (FIG. 2) which is inverted such that the neck of the bottle projects downwards. The top cover 6 is of dished shape with a central aperture 15, so that when the bottle is lowered onto the cooler it is supported by the cover 6 with its neck projecting through the aperture 15.

Figure 3:
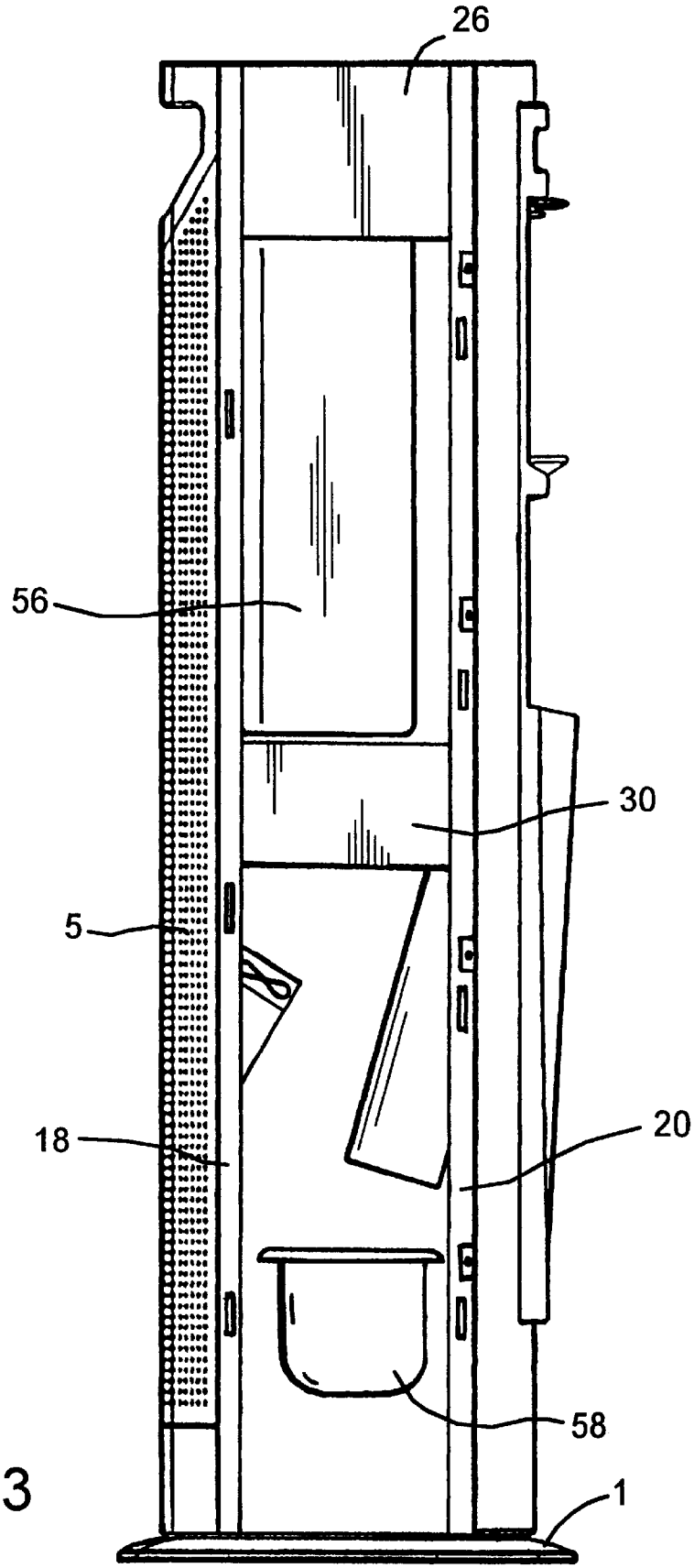
FIG. 3 is a side view of the beverage dispenser with the facing side panel removed.
Figure 4:
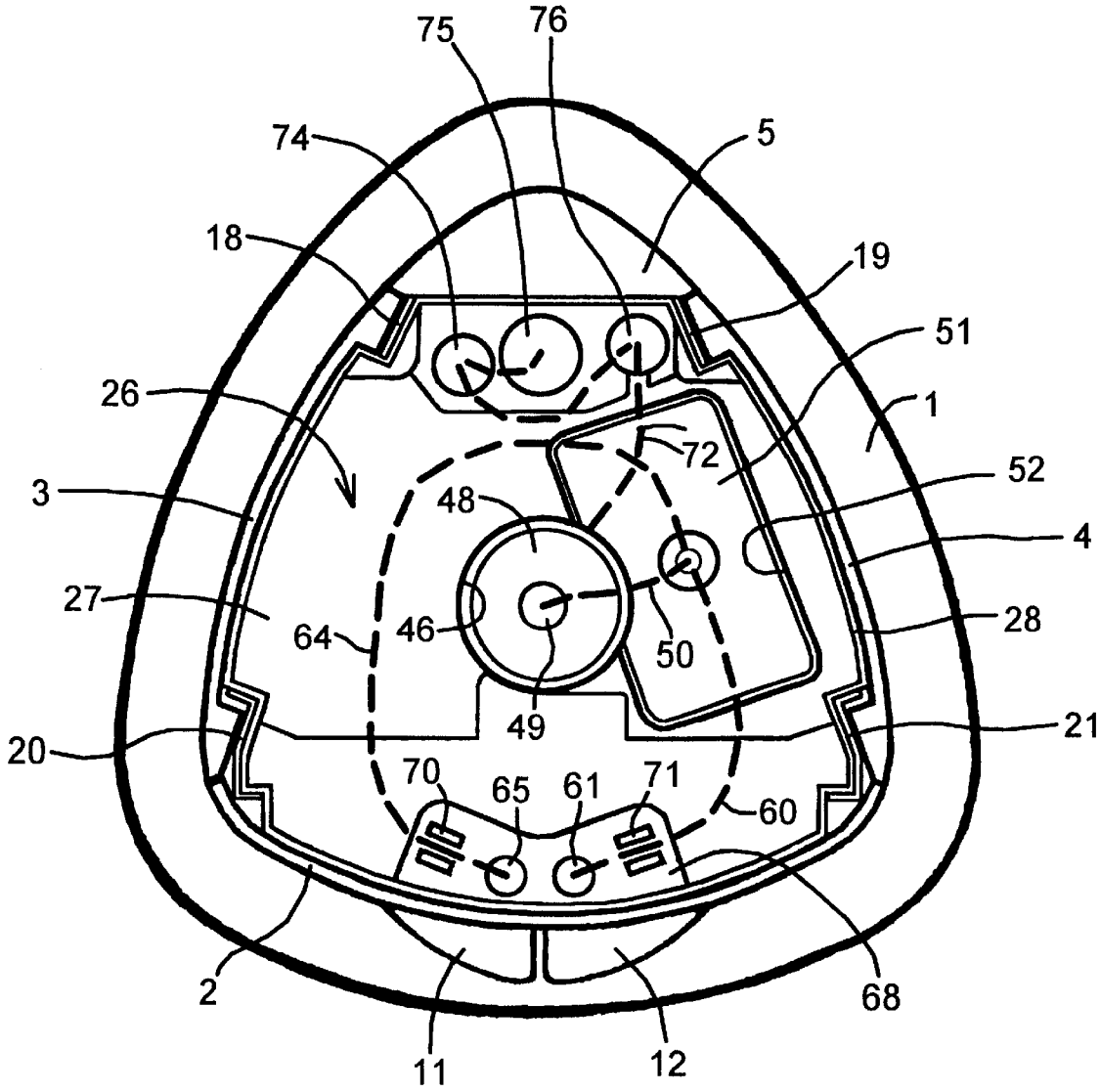
FIG. 4 is a plan view of the beverage dispenser with the top cover removed.

Referring to FIGS. 3 and 4, the ventilation duct 5 is formed of metal, and provides one of the main structural members of the cooler. Opposite sides of the duct are provided with metal flanges 18 and 19 which lie behind the rear margins of the side panels 3 and 4. The cooler also includes a pair of spaced structural members 20, 21 which extend parallel to the duct 5 behind the opposite margins of the front panel 2 and the front margins of the side panels 3, 4. The members 20 and 21 are each comprised of a metal strip which is bent longitudinally for strength and rigidity. A bucket moulding 26, which includes a generally horizontal platform 27 surrounded by an upstanding side wall 28, is mounted below the top cover 6, rigidly fastened to the rear duct 5 and the structural members 20, 21 by means of self-tapping screws. At the bottom of the cooler the members 20, 21 and the duct 5 are fastened to upstanding abutments moulded on the plinth 1 using self-tapping screws. The members 20, 21 and duct 5 are also fastened to an intermediate transverse metal bulkhead 30 by means of rivets or self-tapping screws. The duct 5 and structural members 20, 21 thus provide a rigid internal skeleton for the cooler.

Figure 5:
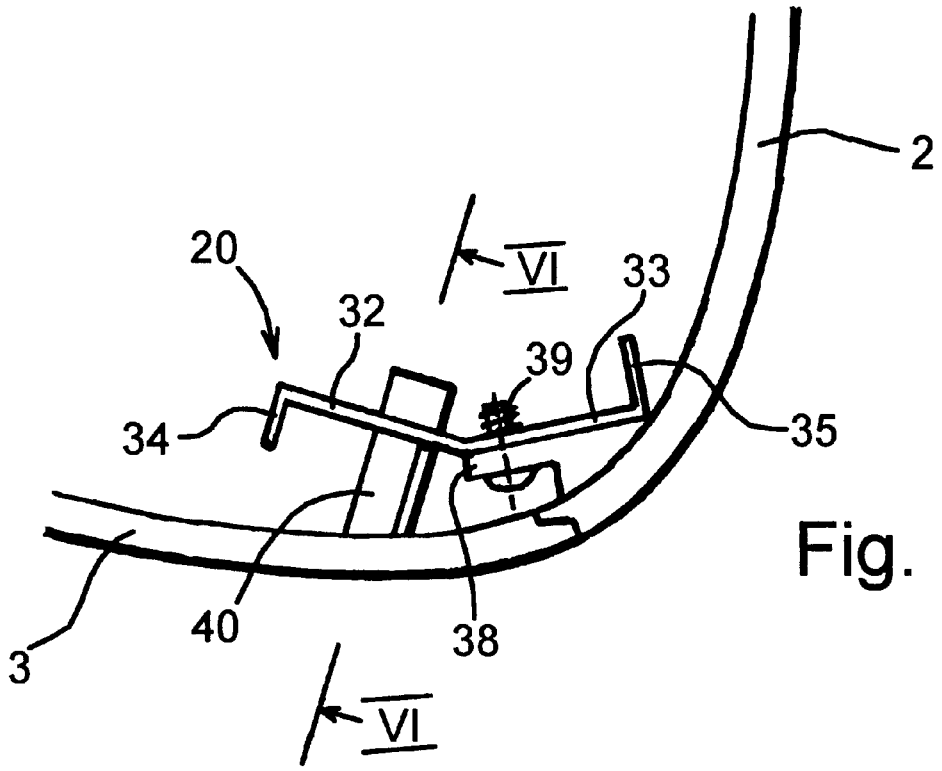
FIG. 5 is a detailed transverse section through a front corner of the beverage dispenser.
Figure 6:
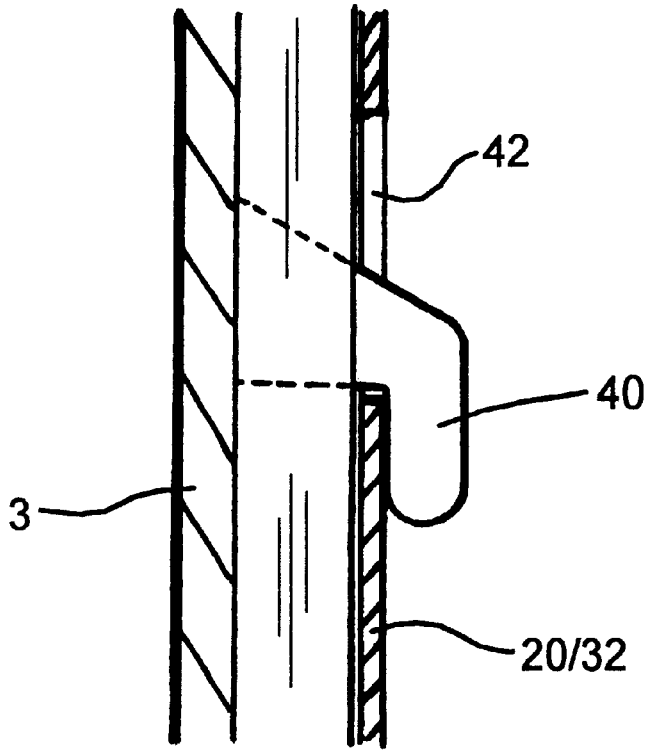
FIG. 6 is vertical section VI—VI of FIG. 5.

Referring to FIG. 5, the members 20 and 21 include a pair of flat angularly inclined sections 32 and 33 with oppositely-directed perpendicular flanges 34 and 35 formed at opposite edges for increased strength. The opposite marginal edges of the front panel 2 are provided with a spaced moulded lugs 38, also visible in FIG. 3, which are used to fasten the front panel to the flat section 33 by means of self tapping screws 39. Thus, the front panel could be removed by removing the screws 39. The adjacent margins of the side panels 3 and 4 are provided with moulded rearwardly-projecting hooks 40, also seen in FIG. 6, which project downwardly for engagement through vertical slots 42 in the flat sections 32. The side panels are also provided with similar hooks are provided for engagement through corresponding slots in the rear flanges 18 and 19. The side panels are thus easily installed by pushing the hooks through the slots and then sliding them downwardly and they can also be quickly removed by a reverse action.

Returning to FIG. 4, the platform 27 is formed with a central recess 46 which holds a cup-shaped coupling 48 into which the neck of the inverted bottle B is inserted through the aperture 15. The coupling 48 includes an integrally moulded feed tube 49 which projects through the neck of the bottle to remove water therefrom. The water is conducted via a flexible pipe indicated at 50 into a moulded reservoir 51 which is removably inserted through an aperture 52 in the platform 27. (In the drawings, pipes and tubes are indicated by dashed lines for clarity.) As seen in FIG. 3, the reservoir is held within an open-topped thermal receptacle 56, e.g. of expanded polystyrene, which is mounted between the top moulding 26 and the bulkhead 30. The receptacle 56 is lined with cooling coils (not shown) which form part of a conventional refrigeration system driven by a compressor 58 mounted at the bottom of the dispenser.

Returning to FIG. 4, cooled water can be removed from the reservoir 51 via a flexible pipe 60 which is inserted through an aperture 61 in the platform 27 into a pinch valve operated by the lever 12. Ambient water can also pass direct from the pipe 50 via a flexible pipe 64 which is inserted through a further aperture 65 in the platform 27 into another pinch valve operated by the lever 11. The pinch valves are mounted within a compartment 68 moulded in the platform 27. The pipes 60 and 64 can be releasably held by clips 70 and 71 secured above the compartment 68. Water displaced from the bottle is replaced by clean air which passes through a separate passage in the feed tube 49. The air is supplied through narrow-bore flexible tubing 72 via (for example) a pressure-release valve 74, an air filter 75 and a non-return valve 76, all of which are inserted into recesses formed at the rear of the platform 27.

Despite the compact and simple construction of the water cooler the periodic replacement of the components which come into contact with the water is very simple. When the bottle is changed the top cover 6 is lifted off and the coupling 48, reservoir 51 and air components 74–76 are pulled out together with the interconnecting pipes and tubes. A clean set of components are inserted into the platform 27 and the cover is replaced.

Figure 7:
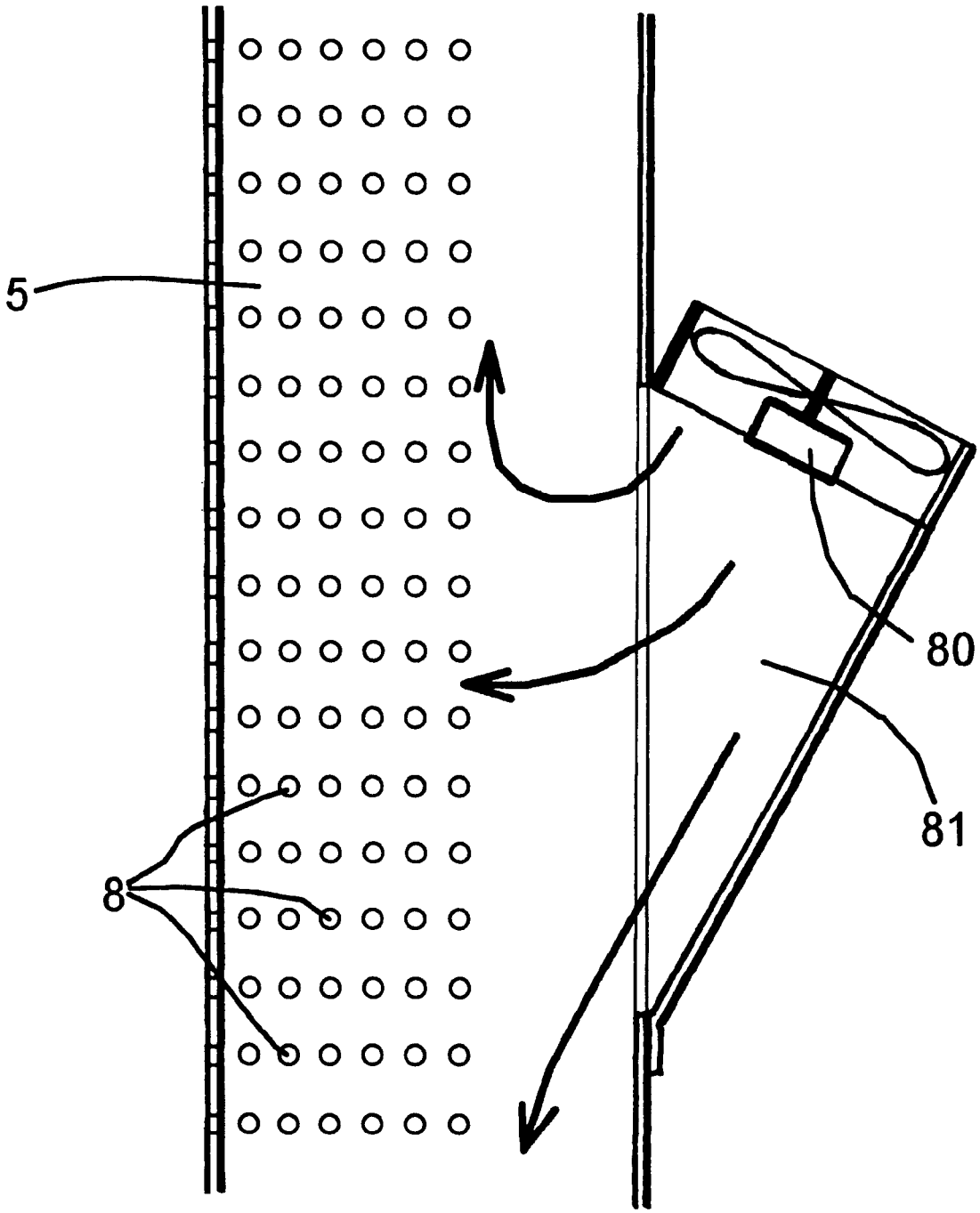
FIG. 7 is a vertical section through part of the rear ventilation duct of the cooler.

Heat produced by the internal electrical components and removed from the chilled water by the refrigeration system is extracted by means of a small electric fan 80 which can be seen in FIG. 3 and is shown in more detail in FIG. 7. The fan is mounted in an upward-facing opening 81 which channels warm air into the ventilation duct 8 to be expelled through the holes 8 at all levels. The air flow could also be reversed to provide a similar cooling effect.

It will be appreciated that the features disclosed herein may be present in any feasible combination. Whilst the above description lays emphasis on those areas which, in combination, are believed to be new, protection is claimed for any inventive combination of the features disclosed herein.

We claim:

1. A beverage dispenser which incorporates:

three vertically elongate walls, namely a front wall and a pair of side walls which converge rearwardly from the front wall;

a top cover which is removably mounted on said elongate walls and which is adapted to receive and support an inverted liquid container with a neck of the container passing through an aperture in said top cover;

a platform mounted below said top cover, said platform being adapted to removably receive and support a coupling member which incorporates a feed tube for insertion into the neck of such a container when supported on the top wall, the platform further containing an opening which is in registration with a thermal receptacle mounted below said platform for removably receiving a reservoir through said opening, said reservoir being connected to the feed tube to receive liquid from said inverted container.

2. A beverage dispenser according to claim 1, in which the front and side walls are generally arcuate in transverse cross-section.

3. A beverage dispenser according to claim 1, in which the platform contains at least one hole for insertion of a conduit through which liquid is removed from the reservoir.

4. A beverage dispenser according to claim 1, in which the platform is adapted to receive an air filter through which air is conducted to the feed tube to replace liquid removed from the bottle.

5. A beverage dispenser according to claim 1, in which the platform incorporates a dispensing valve for controlling the flow of liquid through the conduit.

6. A beverage dispenser according to claim 1, in which the platform is formed as a plastics moulding.

7. A beverage dispenser according to claim 1, in which a ventilation duct extends along the junction of the convergent side walls, said duct containing a plurality of ventilation apertures which communicate with the external atmosphere.

8. A beverage dispenser according to claim 7, including a fan arranged to create a positive air flow between the interior of the housing and the ventilation duct.

9. A beverage dispenser according to claim 7, in which the ventilation duct is rigidly connected with spaced substantially parallel structural members at the front of the housing.

10. A beverage dispenser according to claim 9, in which the platform rigidly connects the ventilation duct with the two structural members.

11. A beverage dispenser according to claim 9, in which a base rigidly connects the duct and structural members at the lower end of the housing.

12. A beverage dispenser according to claim 9, in which a transverse bulkhead rigidly connects the duct with the structural members.

13. A beverage dispenser according to claim 9, in which the front wall of the housing is fastened to the two structural members.

14. A beverage dispenser according to claim 9, in which the two side walls are provided with downwardly-directed hook formations which are inserted into vertical slots provided in one flank of the duct and one of the structural members.

15. A beverage dispenser according to claim 9, in which the structural members include a pair of angularly-inclined wall sections.

16. A beverage dispenser according to claim 15, in which the outer edges of both angularly-inclined sections are provided with substantially perpendicular flanges.

* * * * *